US012256787B2

(12) United States Patent
Prestia

(10) Patent No.: US 12,256,787 B2
(45) **Date of Patent: *Mar. 25, 2025**

(54) CHARGER AND AEROSOL-GENERATING SYSTEM WITH ROTATABLE COVER

(71) Applicant: Philip Morris Products S.A., Neuchatel (CH)

(72) Inventor: Ivan Prestia, Calderara di Reno (IT)

(73) Assignee: Philip Morris Products S.A., Neuchatel (CH)

( * ) Notice: Subject to any disclaimer, the term of this patent is extended or adjusted under 35 U.S.C. 154(b) by 249 days.

This patent is subject to a terminal disclaimer.

(21) Appl. No.: 17/768,546

(22) PCT Filed: Oct. 16, 2020

(86) PCT No.: PCT/EP2020/079287
§ 371 (c)(1),
(2) Date: Apr. 13, 2022

(87) PCT Pub. No.: WO2021/074434
PCT Pub. Date: Apr. 22, 2021

(65) Prior Publication Data

US 2023/0113936 A1 Apr. 13, 2023

(30) Foreign Application Priority Data

Oct. 17, 2019 (EP) ..... 19203952

(51) Int. Cl.
*A24F 40/95* (2020.01)
*A24F 40/40* (2020.01)

(52) U.S. Cl.
CPC ..... *A24F 40/95* (2020.01); *A24F 40/40* (2020.01)

(58) Field of Classification Search
CPC ..... A24F 40/95; A24F 40/40; A24F 40/90; A24F 15/01; A24F 40/60; A24B 15/167; B65D 43/12
See application file for complete search history.

(56) References Cited

U.S. PATENT DOCUMENTS 9,066,543 B2 * 6/2015 Cameron ..... A24F 40/95
11,758,949 B2 * 9/2023 Bagai ..... H02J 7/0045 320/114

(Continued)

FOREIGN PATENT DOCUMENTS

CN 205512351 U 8/2016
CN 107105766 A 8/2017

(Continued)

OTHER PUBLICATIONS

Combined Russian Office Action and Search Report issued Feb. 5, 2024 in Russian Patent Application No. 2022111142/03 (with English Translation), 20 pages.

(Continued)

*Primary Examiner* — Truc T Nguyen
(74) *Attorney, Agent, or Firm* — Oblon, McClelland, Maier & Neustadt, L.L.P.

(57) ABSTRACT

A charger for charging an aerosol-generating device is provided, the charger including: a housing defining a cavity to receive the device to be charged, the cavity having an opening; at least one electrical contact disposed in the cavity; and a cover rotationally slidable relative to the opening between open and closed positions, an inner surface of the cover facing the cavity when the cover is in the closed position, at least a portion of the inner surface of the cover defines a profiled engagement member having a leading edge and a trailing edge, the profiled engagement member sloping into, or towards, the cavity when the cover is in the closed position, a slope increasing in a direction from the (Continued)

leading edge to the trailing edge of the profiled engagement member. An aerosol generating system and a method of operating an aerosol-generating system are also provided.

15 Claims, 6 Drawing Sheets

(56) References Cited

U.S. PATENT DOCUMENTS

| | | | | |
|---|---|---|---|---|
| 2014/0014125 | A1* | 1/2014 | Fernando | A24F 40/50 131/328 |
| 2014/0083443 | A1* | 3/2014 | Liu | A24F 40/95 320/107 |
| 2014/0097103 | A1 | 4/2014 | Cameron | |
| 2015/0034507 | A1* | 2/2015 | Liu | B65D 85/10 206/256 |
| 2016/0101909 | A1* | 4/2016 | Schennum | B65D 25/10 206/268 |
| 2017/0347709 | A1 | 12/2017 | Laakso et al. | |
| 2019/0008208 | A1 | 1/2019 | Cirillo et al. | |
| 2019/0223499 | A1 | 7/2019 | Ouyang | |
| 2020/0221773 | A1 | 7/2020 | An | |
| 2020/0221782 | A1 | 7/2020 | Lim | |
| 2020/0229501 | A1 | 7/2020 | Han et al. | |
| 2020/0268047 | A1 | 8/2020 | Doyle | |
| 2020/0268055 | A1 | 8/2020 | An | |
| 2020/0281273 | A1 | 9/2020 | Kim et al. | |
| 2020/0288778 | A1 | 9/2020 | Kim et al. | |
| 2020/0323264 | A1 | 10/2020 | Kim et al. | |
| 2020/0329772 | A1 | 10/2020 | Kim et al. | |
| 2020/0337374 | A1 | 10/2020 | Han et al. | |
| 2020/0345076 | A1 | 11/2020 | Lim et al. | |
| 2020/0345960 | A1 | 11/2020 | Begin et al. | |
| 2020/0359693 | A1 | 11/2020 | Lee et al. | |
| 2020/0359695 | A1 | 11/2020 | Lim | |
| 2020/0359696 | A1 | 11/2020 | Lim | |
| 2020/0359698 | A1 | 11/2020 | Lim et al. | |
| 2021/0007396 | A1 | 1/2021 | Bellusci et al. | |
| 2022/0273047 | A1* | 9/2022 | Alarcon | H02J 7/0044 |
| 2023/0111319 | A1* | 4/2023 | Prestia | A24F 40/95 131/328 |
| 2024/0065323 | A1* | 2/2024 | Aller | A24F 7/02 |

FOREIGN PATENT DOCUMENTS

| | | | |
|---|---|---|---|
| CN | 206808674 | U | 12/2017 |
| CN | 207927769 | U | 10/2018 |
| CN | 209017885 | U | 6/2019 |
| EP | 3 513 670 | A1 | 7/2019 |
| GB | 2523585 | A | 9/2015 |
| JP | H02101798 | A | 4/1990 |
| JP | 2009021059 | A | 1/2009 |
| JP | 2013119029 | A | 6/2013 |
| KR | 10-1874369 | B1 | 7/2018 |
| KR | 10-2019-0049647 | A | 5/2019 |
| RU | 2 681 866 | C2 | 3/2019 |
| RU | 2 693 705 | C2 | 7/2019 |
| WO | WO 2014/195687 | A1 | 12/2014 |
| WO | WO2018188642 | A1 | 10/2018 |
| WO | WO2019037881 | A1 | 2/2019 |
| WO | WO 2019/084161 | A1 | 5/2019 |
| WO | WO2019081602 | A1 | 5/2019 |
| WO | WO 2019/170896 | A1 | 9/2019 |
| WO | WO2019170897 | A1 | 9/2019 |

OTHER PUBLICATIONS

International Search Report and Written Opinion issued Feb. 12, 2021 in PCT/EP2020/079287 filed on Oct. 16, 2020, 15 pages.
Japanese Office Action Dated Sep. 26, 2024 issued in corresponding Japanese Patent Application No. 2022-522026, filed Oct. 16, 2020, with English Translation.

* cited by examiner

CHARGER AND AEROSOL-GENERATING SYSTEM WITH ROTATABLE COVER

The disclosure relates to a charger for receiving an aerosol-generating article having an improved closing means, an aerosol-generating system comprising the charger and a method of using the aerosol-generating system.

Electrically operated aerosol-generating systems generally comprise an aerosol-forming substrate and an atomiser, which is operated to atomise volatile compounds in the aerosol-forming substrate to form an aerosol for inhalation by a user. Typically, electrically operated aerosol-generating systems also comprise an aerosol-generating device comprising an electrical power supply for supplying power to the atomiser. The atomiser may be an electrically operated heating means, for example an electric heater.

In some systems, an aerosol-generating device is configured to receive an aerosol-generating article comprising a solid aerosol-forming substrate, for example a substrate comprising homogenised tobacco. In these systems, the device typically comprises the atomiser, which is arranged to heat the aerosol-forming substrate when the article is received in the device and a power source connected to the atomiser in the form of a rechargeable battery.

Some electrically operated aerosol-generating systems comprise a separate charger for releasably receiving and recharging the aerosol-generating device when not in use. Typically, the aerosol-generating device will be used frequently. For example, the aerosol-generating device may be used a number of times a day. Therefore, the user will frequently insert and remove the aerosol-generating device into the charger throughout a day.

In some aerosol-generating systems, the charger further comprises a cover. The cover may be moveable from an open position, in which the aerosol-generating device can be received by the charger, and a closed position, in which the aerosol-generating device is protected from dust.

The charger usually comprises an electrical contact. The aerosol-generating device also usually comprises an electrical contact. In order for an aerosol-generating device, received in the charger, to be recharged, the aerosol-generating device should be positioned in the charger such that the electrical contact of the aerosol-generating device is in electrical connection with the electrical contact of the charger when the aerosol-generating device is received in the charger. In the closed position, the cover also prevents users from altering the position of the aerosol-generating device within the charger. However, an electrical connection may not be consistently maintained if the charger is stored in a particular orientation or is dropped by a user of the device. If electrical connection is not consistently maintained while the aerosol-generating device is received in the charger then the aerosol-generating device may not recharge properly. The risk of this is particularly high when the aerosol-generating system is a portable system. Furthermore, there is a risk that the cover may be unintentionally forced from the closed position to the open position.

Furthermore, in many aerosol-generating systems, the cover, in the open position, is typically at risk of being damaged. This is particularly true if the cover, in an open position, protrudes from the charger. For example, the cover may be moveable around a rotation axis wherein, in the closed position, the cover is substantially parallel to and adjacent to a surface of the charger. Having been rotated about the rotational axis, the cover, in the open position, is substantially perpendicular to that surface of the charger.

When the charger protrudes perpendicularly in such a manner, there is a risk of the cover being damaged.

It would be desirable to provide a charger allowing for reliable and efficient charging by ensuring electrical connection between the charger and an aerosol-generating device received in that charger. Given the frequency of use of the aerosol-generating system, it would be desirable to provide a charger that can quickly and simply be manipulated by a user of the device. It would also be desirable to provide a charger with a cover that is robust.

In this disclosure there is provided a charger for charging an aerosol-generating device. The charger may comprise a housing. The housing may define a cavity for receiving the aerosol-generating device to be charged. The cavity may have an opening. At least one electrical contact may be located in the cavity. The charger may comprise a cover. The cover may be rotationally slidable relative to the opening between an open position and a closed position. An inner surface of the cover may face the cavity when the cover is in the closed position. At least a portion of the inner surface of the cover may define a profiled engagement member. The profiled engagement portion may have a leading edge and a trailing edge. The profiled engagement member may slope into, or towards, the cavity when the cover is in the closed position. The slope may increase in a direction from the leading edge to the trailing edge of the profiled engagement member.

In one example, the charger for charging an aerosol-generating device comprises: a housing defining a cavity for receiving the aerosol-generating device to be charged, the cavity having an opening, at least one electrical contact being located in the cavity; and a cover rotationally slidable relative to the opening between an open position and a closed position, an inner surface of the cover facing the cavity when the cover is in the closed position, in which; at least a portion of the inner surface of the cover defines a profiled engagement member having a leading edge and a trailing edge, the profiled engagement member sloping into, or towards, the cavity when the cover is in the closed position, the slope increasing in a direction from the leading edge to the trailing edge of the profiled engagement member.

When the cover is in the open position, an aerosol-generating device can be received by the charger in the cavity. When the cover is in the closed position an aerosol-generating device, received by the charger, is protected from the dust and dirt of the surroundings. In the closed position, the cover also prevents users from altering the position of the aerosol-generating device within the charger. Electrical contact between the at least one electrical contact of the charger and the aerosol-generating device is ensured. Such a charger, advantageously, allows for reliable and efficient charging of the aerosol-generating device received in the cavity. Furthermore, a rotationally slidable cover is advantageously robust.

The profiled engagement member sloping into or towards the cavity, when the cover is in the closed position, advantageously allows engagement of the aerosol-generating device received in the cavity. By engaging the aerosol-generating device, the profiled engagement member advantageously retains the aerosol-generating device in a predetermined position within the cavity. In the predetermined position, the aerosol-generating device may be in electrical connection with the charger. The engagement of the profiled engagement member with aerosol-generating device may advantageously ensure electrical connection between the aerosol-generating device and the charger irrespective of the orientation of the charger or sudden forces applied to the charger, for example, in the case that the charger is dropped.

Electrical connection between the aerosol-generating device and the charger may be achieved when the aerosol-generating device is retained in contact with the at least one electrical contact located in the cavity. In particular, electrical communication may be achieved when at least one electrical contact on the aerosol-generating device is retained in contact with the at least one electrical contact located in the cavity.

As used herein, the term "profiled engagement member" relates to a portion of the of the inner surface of the cover that is configured to engage a surface of an aerosol-generating device received in the cavity of the charger by coming into contact with that surface of the aerosol-generating device when the cover is in the closed position. The profiled engagement portion may engage the aerosol-generating device at some intermediate position of the cover (i.e. at a position between open position and the closed position) and remain engaged with the aerosol-generating device as the cover slides from the intermediate position to the closed position.

As used herein, the term "inner surface of the cover" means a surface of the cover facing the housing of the charger. When the cover is in the closed position, this inner surface faces the cavity defined in the housing of the charger.

As used herein, the term "rotationally slidable" means that the cover is slidable between the open position and the closed position and, when sliding the cover from the open position to the closed position, the cover rotates relative to the charger housing. The rotation may be around an rotation axis. The rotation axis may be positioned somewhere within the cover such that a point of the cover remains fixed relative to the charger housing when the cover is rotated from the open position to the closed position. Alternatively, the rotation axis may be positioned outside of the cover such that no point of the cover remains fixed relative to the charger housing when the cover is rotated from the open position to the closed position.

The cover may comprise a cover opening alignable with the cavity when the cover is in the open position. The cover opening may be configured to allow access to the cavity when the cover is in the open position. This allows an aerosol-generating device to be received and removed from the cavity of the charger when the cover is in the open position. When the cover is in the closed position, the cover opening may not be aligned with the cavity. The cavity-opening cover may be a rotatable disc.

The profiled engagement member may be configured to urge an aerosol-generating device received in the cavity into engagement with the at least one electrical contact when the cover is in the closed position. This advantageously ensures that electrical communication is retained between the aerosol-generating device and the charger. By urging the aerosol-generating device into contact with the at least one electrical contact of the charger, the electrical resistance between the at least one contact and the aerosol-generating device may be significantly reduced. This may ensure efficient charging of the aerosol-generating device.

As used herein, the term "urges" or "urging" means that a force is applied by one component to another component.

The profiled engagement member may protrude into, or towards, the cavity when the cover is in the closed position. The protrusion of the profiled engagement member may increase in a direction from the leading edge to the trailing edge of the profiled engagement member. This is a result of the slope of the profiled engagement member increasing into or toward the cavity from the leading edge to the trailing edge.

Preferably, the leading edge may not extend into, or toward, the cavity enough to engage with an aerosol-generating device received in the cavity. Therefore, when the cover rotationally slides from the open position to the closed position, the profiled engagement member does not immediately engage the aerosol-generating device received in the cavity. Rotationally sliding the cover further toward the closed position may cause the profiled engagement portion to protrude into or towards the cavity to an extent that it engages the aerosol-generating device received in the cavity and then increasingly urges the aerosol-generating device into engagement with the at least one electrical contact. This configuration advantageously results in a smooth engagement of the profiled engagement member with the aerosol-generating device.

Rotationally sliding the cover from the open position to the closed position may move the profiled engagement member into an overlapping relationship with the cavity. In this overlapping relationship, the profiled engagement member can advantageously interact with, and engage, an aerosol-generating device received in the cavity. The leading edge of the profiled engagement member may move into an overlapping relationship with the cavity first as the cover slides from the open position to the closed position.

The slope of the profiled engagement member may increase linearly into or toward the cavity from the leading edge to the trailing edge. Alternatively, the slope may increase non-linearly. For example, the rate of change of increase of the slope may increase from the leading edge to the trailing edge. The increasing protrusion into or toward the cavity of such a cover may be slow at first and then increase more rapidly as the cover slides from the open position. The non-linear slope may be configured such that there is a smooth engagement of the profiled engagement member while the rate of increase of the slope is low. After engagement, the aerosol-generating device may be quickly urged into the cavity, ensuring electrical connection. As such, a non-linear increase in the slope of the profiled engagement portion may reduce the necessary distance of travel of the cover from open position to the closed position.

While reference to the cover being rotationally slidable from the open position to the closed position is made throughout, the cover is equably rotationally slidable from the closed position to the open position.

Preferably, the at least one electrical contact of the charger is a resilient element.

As used herein, the term "resilient element" relates to an element that may be deformed or deflected by an applied force, but is capable of returning to its original position or state after the applied force is removed. When a resilient element is deformed or deflected by a force applied by a component moving towards the resilient element, the resilient element generates a reactive force that urges the component to move away from the resilient element. Examples of resilient elements include helical springs and cantilever springs.

The at least one electrical contact may be a resilient element configured to apply a force to an aerosol-generating device received in the cavity in the direction of the cavity opening when the cover is in the closed position. When the cover is in the closed position, the force applied by the resilient element advantageously urges the aerosol-generating device against the cover and, in particular, against the profiled engagement member of the cover. The cover, in the closed position, advantageously ensures electrical communication between the aerosol-generating device and the charger.

The charger may comprise an aerosol-generating device release mechanism. The aerosol-generating device release mechanism may be located in the cavity. The aerosol-generating device release mechanism may comprise a resilient element. The resilient element may be configured to urge an aerosol-generating device received in the cavity in the direction of the cavity opening when the cover is in the closed position. The aerosol-generating device release mechanism may be configured to urge an aerosol-generating device received in the cavity in the direction of the cavity opening when the cover is in the open position. The aerosol-generating device release mechanism may be configured to urge the aerosol-generating device at least partially out of the cavity when the cover is in the open position.

By urging the aerosol-generating device out of the cavity, the aerosol-generating device may be more easily removed from the charger by a user of the device. This is because a region of the aerosol-generating device upon which a user can hold on to may be provided. A user of the charger can grab onto, and interact with, this region making it easier to insert or remove an aerosol-generating from the charger.

The aerosol-generating release mechanism may be a resilient element in the form of a helical spring or cantilever spring that is located in the cavity of the charger.

The charging device may comprise a primary power source. The primary power source may be electrically couplable to the at least one electrical contact of the charger. The aerosol-generating device may comprise a secondary power source. The secondary power source may be electrically couplable to the at least one electrical contact of the aerosol-generating device.

The primary power source and the secondary power source may comprise any suitable types of electrical power supplies. The primary power source and the secondary power source may comprise one or more of batteries and capacitors. The primary power source and the secondary power source may comprise lithium ion batteries. The primary power source and the secondary power source may be rechargeable electrical power supplies. The primary power source and the secondary power source may be identical. The primary power source and the secondary power source may be different. The primary power source may have a larger size or capacity than the secondary power source of the aerosol-generating device. When the charger and the aerosol-generating device are electrically connected this may allow electrical communication between the primary power source and the second power source. Electrical communication between the primary power source and the secondary power source may allow the primary power source to be used to recharge the secondary power source. Therefore, the profiled engagement member ensuring connection between the aerosol-generating device and the charger advantageously ensures that the primary source recharges the secondary power source when the aerosol-generating device is received in the charger and the cover is in the closed position.

The cavity of the charger may have dimensions that substantially correspond to the dimensions of the aerosol-generating device to be received in the cavity. Preferably, the cavity is an elongate cavity extending from an opening in a surface of the cartridge housing to a closed end located within the cartridge housing. The length of the cavity from its opening to its closed end is preferably substantially similar to the length of the aerosol-generating device to be received in the cavity. An aerosol-generating device received in the cavity of the charger may extend out of or above the opening of the cavity when received in the cavity. This extension out of, or above, the cavity may be the result of the at least one electrical contacts of the charger urging the aerosol-generating device out of the cavity.

The profiled engagement member may be a cam surface. A surface of the aerosol-generating device received in the cavity may be a cam rider. In particular, the top surface of the aerosol-generating device may be a cam rider.

As used herein, the term "cam surface" refers to a surface of a first component that is configured to contact a portion of a second component. As used herein, the term "cam rider" refers to a portion of the second component configured to contact the cam surface. The cam surface and cam rider are configured such that motion of the first component is transferred to the second component through the contact between cam surface and the cam rider. Typically, the cam surface passes over the cam rider.

The profiled engagement member, as a cam surface, may be configured to transfer the rotational sliding motion of the cover to the aerosol-generating device, as a cam rider. The aerosol-generating device may follow or ride the slope of the profiled engagement member as the cover moves from the open position to the closed position. As the profiled engagement member slopes into, or towards, the cavity, the aerosol-generating device is pushed in a direction towards the cavity when the cover is moved from the open position to the closed position. This advantageously urges the aerosol-generating device against the electrical contact in the cavity.

The aerosol-generating device may only ride the profiled engagement member after the profiled engagement member has engaged that aerosol-generating device.

The cover, in rotationally sliding between the open position and the closed position, may move in a sliding plane.

As used herein, the term "sliding plane" refers to a plane in which the cover lies when the cover is in the closed position, the open position, or any intermediate position between the closed position and the open position. The sliding plane may lie in an x and y direction in a Cartesian coordinate system. The cover may substantially extend in the x and y directions. When the cover rotationally slides in the sliding plane, the cover may rotate about a point in the sliding plane (i.e. a point falling in the plane lying in an x and y direction). In other words, the cover being may follow a curved path when sliding from the open position to the closed position.

As described above, the profiled engagement member may be a curved rib. The curve of the profiled engagement member may follow the curved sliding path of the cover such that the profiled engagement member remains in an overlapping relationship with the cavity as the cover rotationally slides from the open position to the closed position.

The direction of the slope of the profiled engagement member may be out of the sliding plane. The profiled engagement member may slope out of the sliding plane towards the cavity, when the cover is in the closed position.

As used herein, the term "out of the sliding plane" means that a non-zero component of the slope of the profiled engagement member lies in a direction that is orthogonal to both the x-direction and the y-direction defined by the sliding plane. In other words, a non-zero component of the slope of the profiled engagement member is in a z-direction in the Cartesian coordinate system defined by the sliding plane.

The cover may comprise an outer surface extending substantially parallel to the sliding plane. The outer surface may be positioned on an opposite side of the cover to the inner surface. The inner surface of the cover may comprise a portion that does not slope into, or towards, the cavity when the cover is in the closed position. The portion of the inner surface of the cover may extend substantially parallel to the sliding plane. The portion of the inner surface of the cover may extend substantially parallel to the outer surface of the cover.

The housing of the charger may comprise a bottom wall, a top wall and a sidewall. The housing of the charger may be cylindrical.

The terms "front", "back", "upper", "lower", "side", "top", "bottom", "left", "right" and other terms used to describe relative positions of the components of the charger and the aerosol-generating device refer to the charger in an upright position with the opening of the cavity configured to receive the aerosol-generating device at the top end. The cavity may be formed in the top end. The sliding plane, described above, may be substantially parallel to the top end.

The term "longitudinal" refers to a direction from bottom to top or vice versa.

The housing of the charger may comprise a face over which the cover is rotationally slidable. This face may be the top surface. When sliding the cover from the open position to the closed position, the inner surface of the cover may not slide beyond this face of the housing. The cover may not protrude from the device when in the open position and so there is no position in which the cover has an increased risk of damage. The face of the housing over which the cover slides may lie in a plane substantially parallel to the sliding plane described above. Such an arrangement is advantageously robust.

As described above, the cover may rotate about a point centrally located in the cover. If the cover is a circular disc, this means that the rotationally sliding cover remains in a fixed position relative to a charger whether the cover is in the open position or the closed position. The cover is preferably in a fixed position relative to the top surface of the charger.

The charger may comprise an actuation member. The charger may comprise a means to slide the cover from the open position to the closed position in response to manipulation of the actuation member by a user of the charger. By providing an actuation member to operate the cover, the process of opening and closing the charger is simplified and made more comfortable for the user. For example, an actuation member on the charger housing may advantageously be positioned such that user holding the charger in one hand can use that same hand to manipulate the actuation member. This may be more comfortable than moving the cover itself.

The actuation member may be a rotatable disc. The rotatable disc may be configured to be rotated be a user of the charger. Rotation of the rotatable disc may cause the cover to move from the open position to the closed position. The rotatable disc may be positioned parallel to the bottom surface of the charger.

The means to slide the cover may be a mechanical linkage between the rotatable disc and the cover. The mechanical linkage may be a rigid shaft connecting the actuation member to cover. When the actuation member is a rotatable disc, the shaft may directly transfer rotational motion of the rotatable disc to the cover.

Alternatively, the actuation member may be a button or switch. The means to slide the cover may comprise an actuator and a mechanical linkage between the actuator and the cover. The actuation member may be configured to send an electrical signal to actuator in response to manipulation of the actuation member by a user of the charger. The actuator may be an electric motor configured to create rotational motion. This rotational motion may be transferred to the cover via the mechanical linkage.

The cover may be biased towards the closed position. The cover may be biased towards the closed position by a spring attached to the cover at a first end of the spring and to the housing of the charger at a second end of the spring. The cover being biased to the closed position advantageously means that the position of the cover is urged towards the closed position. Whenever the cover is in the open position, a biasing force may urge the cover back to the closed position without the need for a user to manipulate the actuation element. This advantageously prevents the user from inadvertently leaving the cover in the open position. It also advantageously means that if the cover is inadvertently forced open, for example when the charger is stored in a user's pocket, it will automatically close again.

As used herein, the term 'aerosol-generating device' refers to a device that interacts with an aerosol-forming substrate to generate an aerosol that is directly inhalable into a user's lungs thorough the user's mouth. In certain embodiments, an aerosol-generating device may heat an aerosol-forming substrate to facilitate the release of the volatile compounds. An aerosol-generating device may interact with an aerosol-generating article comprising an aerosol-forming substrate or a cartridge comprising an aerosol-forming substrate. An electrically operated aerosol-generating device may comprise an atomiser, such as an electric heater, to heat the aerosol-forming substrate to form an aerosol.

As used herein, the term 'aerosol-forming substrate' is used to describe a substrate capable of releasing upon heating volatile compounds, which can form an aerosol. The aerosol generated from aerosol-forming substrates of aerosol-generating articles described herein may be visible or invisible and may include vapours (for example, fine particles of substances, which are in a gaseous state, that are ordinarily liquid or solid at room temperature) as well as gases and liquid droplets of condensed vapours.

The aerosol-forming substrate may be a solid aerosol-forming substrate. The aerosol-forming substrate may comprise both solid and liquid components.

Preferably, the aerosol-forming substrate comprises nicotine. More preferably, the aerosol-forming substrate comprises tobacco.

Alternatively or in addition, the aerosol-forming substrate may comprise a non-tobacco containing aerosol-forming material.

If the aerosol-forming substrate is a solid aerosol-forming substrate, the solid aerosol-forming substrate may comprise, for example, one or more of: powder, granules, pellets, shreds, strands, strips or sheets containing one or more of: herb leaf, tobacco leaf, tobacco ribs, expanded tobacco and homogenised tobacco.

Optionally, the solid aerosol-forming substrate may contain tobacco or non-tobacco volatile flavour compounds, which are released upon heating of the solid aerosol-forming substrate. The solid aerosol-forming substrate may also contain one or more capsules that, for example, include additional tobacco volatile flavour compounds or non-tobacco volatile flavour compounds and such capsules may melt during heating of the solid aerosol-forming substrate.

Optionally, the solid aerosol-forming substrate may be provided on or embedded in a thermally stable carrier. The carrier may take the form of powder, granules, pellets, shreds, strands, strips or sheets. The solid aerosol-forming substrate may be deposited on the surface of the carrier in the form of, for example, a sheet, foam, gel or slurry. The solid aerosol-forming substrate may be deposited on the entire surface of the carrier, or alternatively, may be deposited in a pattern in order to provide a non-uniform flavour delivery during use.

If the aerosol-forming substrate is a liquid, the aerosol-generating article or cartridge may comprise a means for retaining the liquid substrate. The aerosol-forming substrate may alternatively be any other sort of substrate, for example, a gas substrate, a gel substrate, or any combination of the various types of substrate.

Preferably, the aerosol-forming substrate comprises an aerosol former.

As used herein, the term 'aerosol former' is used to describe any suitable known compound or mixture of compounds that, in use, facilitates formation of an aerosol and that is substantially resistant to thermal degradation at the operating temperature of the aerosol-generating article.

Suitable aerosol-formers are known in the art and include, but are not limited to: polyhydric alcohols, such as propylene glycol, triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate Preferred aerosol formers are polyhydric alcohols or mixtures thereof, such as propylene glycol, triethylene glycol, 1,3-butanediol and, most preferred, glycerine.

The aerosol-forming substrate may comprise a single aerosol former. Alternatively, the aerosol-forming substrate may comprise a combination of two or more aerosol formers.

Preferably, the aerosol-forming substrate has an aerosol former content of greater than 5% on a dry weight basis.

The aerosol aerosol-forming substrate may have an aerosol former content of between approximately 5% and approximately 30% on a dry weight basis.

In a preferred embodiment, the aerosol-forming substrate has an aerosol former content of approximately 20% on a dry weight basis.

In this disclosure there is also provided an aerosol generating system comprising a charger and an aerosol-generating device. The charger may comprise a housing. The housing may define a cavity for receiving the aerosol-generating device to be charged. The cavity may have an opening. At least one electrical contact may be located in the cavity. The charger may comprise a cover. The cover may be rotationally slidable relative to the opening between an open position and a closed position. An inner surface of the cover may face the cavity when the cover is in the closed position. At least a portion of the inner surface of the cover may define a profiled engagement member. The profiled engagement member may have a leading edge and a trailing edge. The profiled engagement member may slope into, or towards, the cavity when the cover is in the closed position. The slope may increase in a direction from the leading edge to the trailing edge of the profiled engagement member. When the aerosol-generating device is received in the cavity, the profiled engagement member may be configured to urge the aerosol-generating device into engagement with the at least one electrical contact when the cover is in the closed position.

In one example of the aerosol-generating system, the charger comprises: a housing defining a cavity for receiving the aerosol-generating device to be charged, the cavity having an opening, at least one electrical contact being located in the cavity; and a cover rotationally slidable relative to the opening between an open position and a closed position, an inner surface of the cover facing the cavity when the cover is in the closed position, in which; at least a portion of the inner surface of the cover defines a profiled engagement member having a leading edge and a trailing edge, the profiled engagement member sloping into, or towards, the cavity when the cover is in the closed position, the slope increasing in a direction from the leading edge to the trailing edge of the profiled engagement member. Then the aerosol-generating device is received in the cavity, the profiled engagement member is configured to urge the aerosol-generating device into engagement with the at least one electrical contact when the cover is in the closed position. Features of the charger described above may apply to the charger of the aerosol-generating system.

When the cover of the charger is in the open position, an aerosol-generating device can be received by the charger in the cavity. When the cover is in the closed position aerosol-generating device is protected from dust and dirt of the surroundings. In the closed position, the cover also prevents users from altering the position of the aerosol-generating device within the charger and electrical contact between the at least one electrical contact of the charger and the aerosol-generating device is ensured. Such a charger, advantageously, allows for reliable and efficient charging of the aerosol-generating device received in the cavity.

Urging the aerosol-generating device into engagement with the at least one electrical contact ensures that electrical communication is retained between the aerosol-generating device and the charger.

The cover may be a rotatable disk.

The cover may comprise a cover opening alignable with the cavity to provide access to the cavity when the cover is in the open position.

The at least one electrical contact of the charger may be a resilient element. The resilient element may be configured to apply a force to an aerosol-generating device received in the cavity in the direction of the cavity opening when the cover in the closed position.

The charger may comprise an aerosol-generating device release mechanism. The aerosol-generating device release mechanism may be located in the cavity. The aerosol-generating device release mechanism may comprise a resilient element.

Rotationally sliding the cover from the open position to the closed position may move the profiled engagement member into an overlapping relationship with the cavity. The leading edge of the profiled engagement member may move into an overlapping relationship with the cavity first as the cover slides from the open position to the closed position.

The charging device may comprise a primary power source. The primary power source may be electrically couplable to the at least one electrical contact of the charger. The aerosol-generating device may comprise a secondary power source. The secondary power source may be electrically couplable to the at least one electrical contact of the aerosol-generating device. Electrical communication between the primary power source and the secondary power source may allow the primary power source to be used to recharge the secondary power source. Therefore, the profiled engagement member ensuring connection between the aerosol-generating device and the charger advantageously ensures that the primary source recharges the secondary power source when the aerosol-generating device is received in the charger and the cover is in the closed position.

The cavity of the charger may have dimensions that substantially correspond to the dimensions of the aerosol-generating device to be received in the cavity. The length of the cavity from its opening to its closed end is preferably substantially similar to the length of the aerosol-generating device to be received in the cavity.

The profiled engagement member may protrude into, or towards, the cavity when the cover is in the closed position.

The profiled engagement member may be a cam surface and a surface of the aerosol-generating device received in the cavity may be a cam rider.

The cover, in rotationally sliding between the open position and the closed position, may move in a sliding plane.

The charger may comprise an actuation member. The charger may comprise a means to slide the cover from the open position to the closed position in response to manipulation of the actuation member by a user of the charger.

The actuation member may be a rotatable disc. The means to slide the cover may be a mechanical linkage between the rotatable disc and the cover.

Alternatively, the actuation member may be a button or switch. The means to slide the cover comprises an actuator and a mechanical linkage between the actuator and the cover.

The cover may be biased towards the closed position. The cover may be biased towards the closed position by a spring attached to the cover at a first end of the spring and to the housing of the charger at a second end of the spring.

In this disclosure there is provided a method of using an aerosol-generating system comprising a charger and an aerosol-generating device; the charger comprising: a housing defining a cavity for receiving the aerosol-generating device to be charged, the cavity having an opening; at least one electrical contact being located in the cavity; and a cover rotationally slidable relative to the opening between an open position and a closed position, an inner surface of the cover facing the cavity when the cover is in the closed position, in which; at least a portion of the inner surface of the cover defines a profiled engagement member having a leading edge and a trailing edge, the profiled engagement member sloping into, or towards, the cavity when the cover is in the closed position, the slope increasing in a direction from the leading edge to the trailing edge of the profiled engagement member; the method comprising:

- inserting the aerosol-generating device into the cavity of the charger when the cover is in the open position; and
- sliding the cover from the open position to the closed position;
- wherein, in the closed position, the profiled engagement member urges the aerosol-generating device into engagement with the at least one electrical contact.

While an aerosol-generating device is received in the cavity, and the cover is in the closed position, the charger may charge the aerosol-generating device. A controller in the charger may couple a primary power supply of the charger with the at least one electrical contact of the charger. The aerosol-generating device, being engaged with the at least one electrical contact, may be in electrical communication with the at least one electrical contact, for example, via at least one electrical contact on the aerosol-generating device. A secondary power supply, located in the aerosol-generating device may, therefore, be charged by the primary power supply of the charger. The charging of the aerosol-generating device may be regulated by the controller of the charger.

The method may also comprise the step of sliding the cover from the closed position to the open position to remove the aerosol-generating device received in the charger.

The charger may comprise an aerosol-generating device release mechanism. The release mechanism may urge the aerosol-generating device out of the cavity when the cover is in the open position. The user of the aerosol-generating system may use this portion to pull the aerosol-generating device out of the cavity.

The step of sliding the cover from the open position to the closed position (or vice versa) may comprise a user manipulating the cover of the charger directly. Alternatively, the charger may comprise an actuation member in the form of a slider, a switch or a button. Manipulation of the actuation member may operate the cover. Manipulation of the actuation member may cause the cover to slide from the open position to the closed position.

When the charger comprises a biasing element, the step of inserting an aerosol-generating device into the cavity of the device may comprise applying a force on the cover against the biasing element to hold the cover in the open position. This force may be applied be a user directly to the cover. Alternatively, the force may be applied via the means to slide the cover. The step of sliding the cover from the open position to the closed position may comprise removing the force holding the cover in the open position such that the cover moves to the closed position automatically, as a result of the biasing element.

Features described in relation to one example or embodiment may also be applicable to other aspects and embodiments. For example, features described in relation to aerosol-generating articles and aerosol-generating systems described above may also be used in conjunction with methods of using aerosol-generating articles and aerosol-generating systems described above.

Specific embodiments will now be described with reference to the figures, in which:

FIG. 1 shows a schematic illustration of a known electrically operated aerosol-generating system comprising an aerosol-generating article, an aerosol-generating device and a charging device for charging the aerosol-generating device;

FIG. 2 shows a perspective view of a charger according to the invention, comprising a cover slidable between an open position and a closed position. FIG. 2*a* shows the cover in the open position. FIG. 2*b* shows the cover in the closed position.

FIG. 3 shows a cross-section schematic view of the charger of FIG. 2, with an aerosol-generating device received in a cavity of the charger. FIG. 3*a* shows the cover in an open position. FIG. 3*b* shows the cover in the closed position. FIG. 3*c* shows the cover in an intermediate position between the open position and the closed position.

Figure 1:
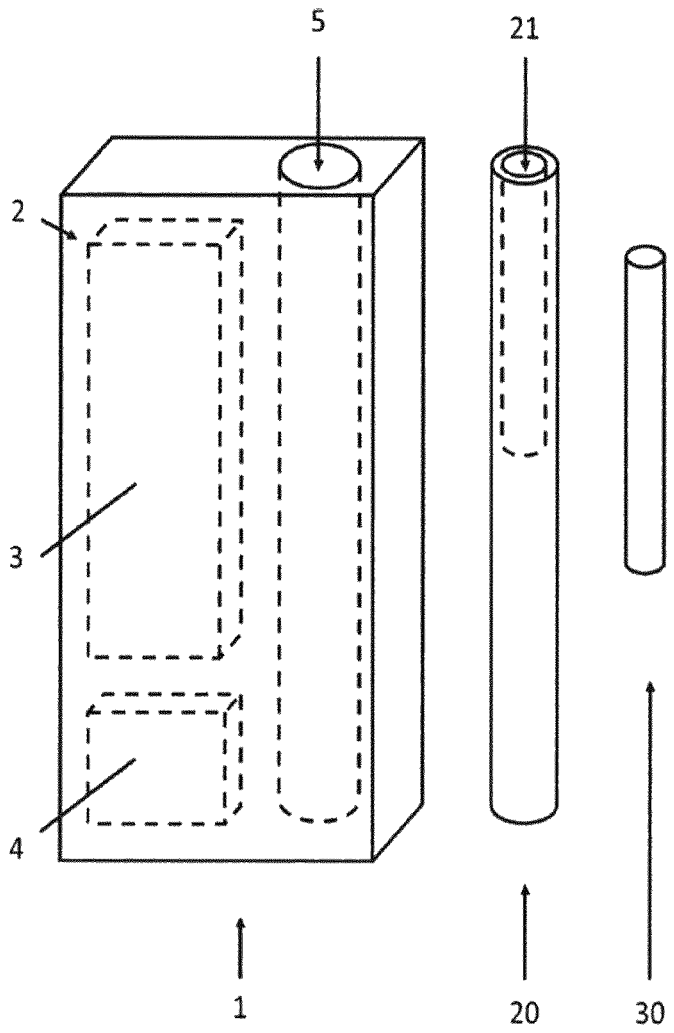

FIG. 1 shows a schematic illustration of a known electrically operated aerosol-generating system. The known electrically operated aerosol-generating system comprises a charger 1, an aerosol-generating device 20 and an aerosol-generating article 30.

The charger 1 comprises a housing 2 having the general size and shape of a conventional packet of cigarettes. A lithium-ion battery 3 and electric circuitry 4 are housed within the charger 1. The charger 1 further comprises a generally circularly-cylindrical cavity 5 for receiving the aerosol-generating device 20. The cavity 5 is defined by the housing 2. An electrical contact (not shown) is arranged at a closed end of the cavity 5 for electrically connecting an aerosol-generating device received in the cavity 5 to the battery 3 of the charging device 1.

The aerosol-generating device 20 is substantially circularly cylindrical and has the general dimensions of a conventional cigar. The length of the device 20 is substantially identical to the length of the cavity 5 and the diameter of the device 20 is slightly smaller than the diameter of the cavity 5, such that the device 20 fits closely in the cavity 5. The aerosol-generating device 20 comprises an open cavity 21 at a proximal end for receiving an aerosol-generating article. The aerosol-generating device 20 further comprises a battery (not shown) housed in the housing of the device and an electric heater (not shown) arranged in the cavity 21 for heating at least a portion of the aerosol-generating article 30 when the aerosol-generating article 30 is received in the cavity 21.

The aerosol-generating article 30 comprises an aerosol-forming substrate (not shown) comprising a gathered, crimped sheet of tobacco, and a filter (not shown) arranged back to back with the aerosol-forming substrate in the form of a rod. The aerosol-generating article 30 has a diameter substantially equal to the diameter of the cavity 21 of the device 20 and a length longer than the cavity 21, such that when the article 30 is received in the cavity 21 of the device 20, the filter extends out of the cavity 21 and may be drawn on by a user, similarly to a convention cigarette.

In use, a user inserts the article 30 into the cavity 21 of the device 20 and turns on the device 20 to activate the electric heater. The electric heater heats the aerosol-forming substrate of the article 30 such that volatile compounds of the aerosol-forming substrate are released and atomised to form an aerosol. The user draws on the mouthpiece of the article 30 and inhales the aerosol generated from the heated aerosol-forming substrate. After use of the device 20, the article 30 may be removed from the device 20 for disposal, and the device 20 may be placed into the charger 1 for storage and for charging of the battery of the device 20.

FIG. 2 shows a perspective view of a charger 100 according to the invention. The charger comprises a charger housing 102 and a cover 110. The cover comprises a cover opening 126. In the charger housing 102, a cavity 120 for receiving an aerosol-generating device is defined. The cavity 120 comprises cavity walls 122 and a cavity opening 124. These features are not visible in the perspective view of FIG. 2. However, the cavity, cavity walls and cavity opening are represented by the dotted lines in FIG. 2 to show the relative position of the cover opening 126 and the cavity 120. The cavity opening 124 is defined in a top surface of the charger housing.

The charger also comprises two electrical contacts (not shown in FIG. 2) located in the cavity, and a power supply in the form of a rechargeable battery (not shown). The rechargeable battery is couplable to the electrical contacts located in the cavity.

The charger housing 102 has a cylindrical shape, with the cover 110 positioned adjacent the top flat surface of the charger housing 102. The cover 110 also has a cylindrical shape. The diameter of the cover matches the diameter of the charger housing 102 and centres of the cover and the top surface of the charger housing are aligned such that the cover does not extend beyond the top surface of the charger housing 102.

Figure 2B:
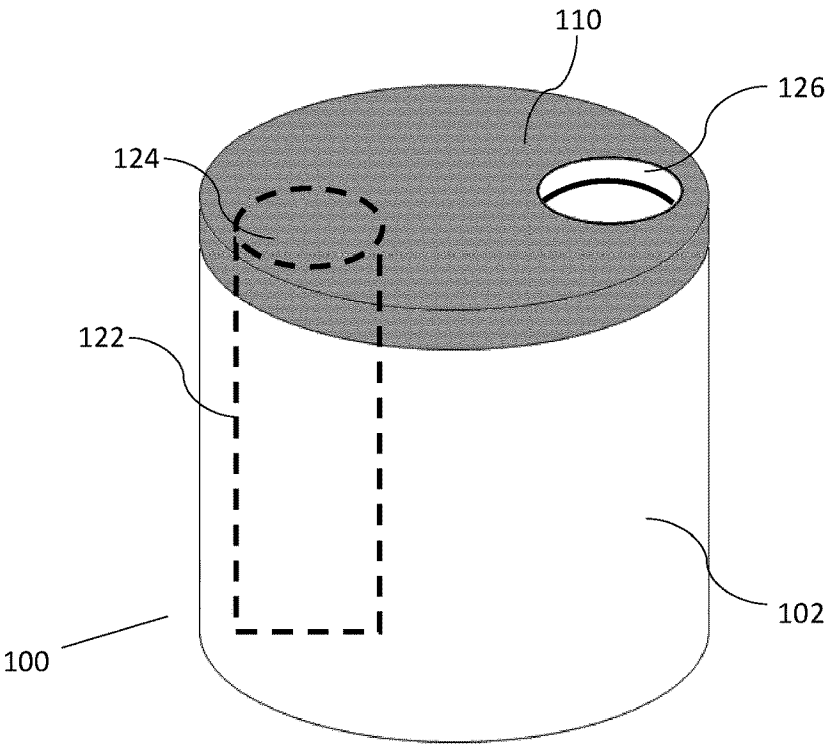
Figure 2A:
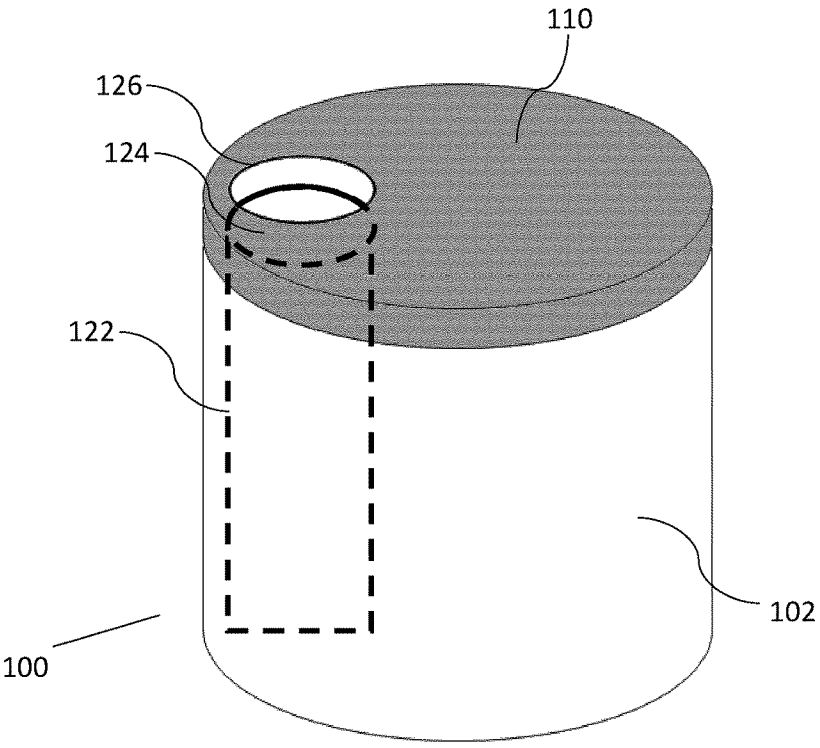

The cover 110 is rotationally slidable between an open position, shown in FIG. 2*a*, and a closed position, shown in FIG. 2*b*. In the open position, the cover opening 126 is aligned with cavity 120 such that the cavity 120 is accessible and an aerosol-generating device can be received by the charger 100 in the cavity 120. In the closed position, the cover opening 126 is no longer aligned with the cavity 120 and the cover 110 closes the cavity 120 by facing the cavity opening 124. Closing the cavity protects the cavity 120 from dust and prevents users from altering the position of an aerosol-generating device received within the cavity 120 of the charger 100. The charger housing 102 acts as a case for an aerosol-generating device received in the cavity and provides protection for an aerosol-generating device. The cover 110 also acts to ensure electrical contact between an aerosol-generating device received in the cavity and the electrical contacts of the charger (not shown in FIG. 2) located in the cavity 120. This is described in more detail below in relation to FIG. 3.

Figure 3C:
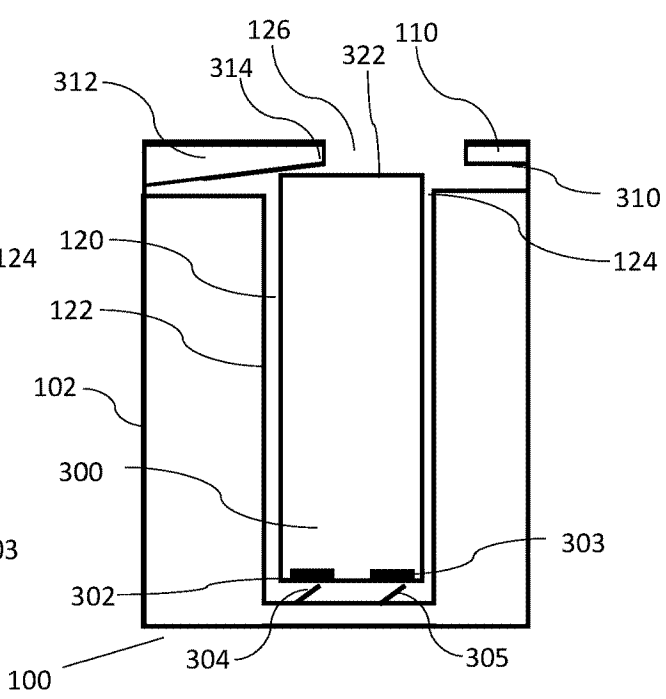
Figure 3B:
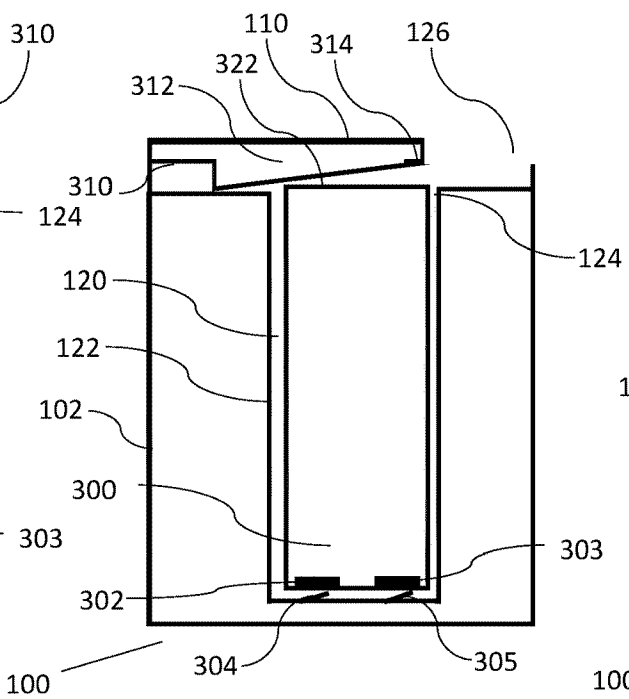
Figure 3A:
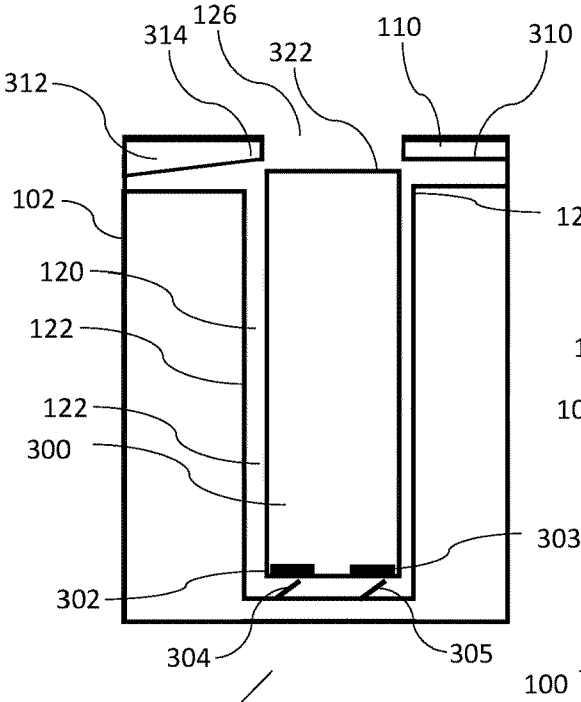
Figure 4:
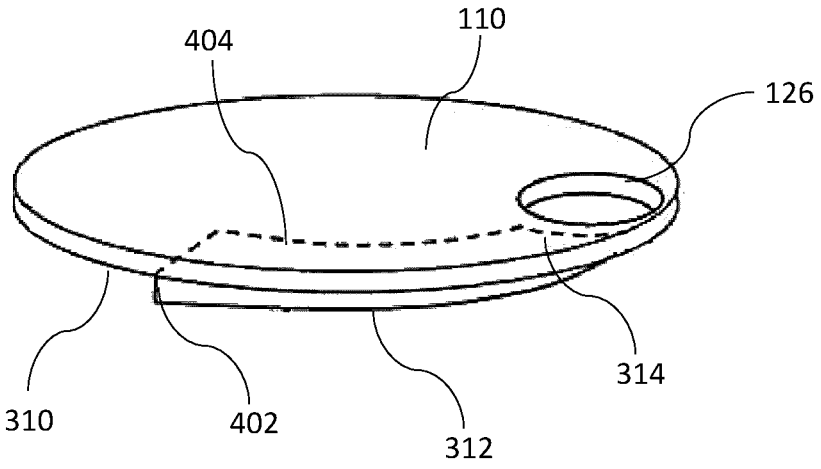
FIG. 4 shows a perspective view of the cover separately to the charger.

FIG. 3 shows a cross-sectional view of the charger 100 with an aerosol-generating device 300 received in the cavity 120. FIG. 3*a* shows the cover 110 in the open position, FIG. 3*b* shows the cover 110 in the closed position and FIG. 3*c* shows the cover in an intermediate position between the open position and the closed position. In the open position, the cover opening 126 is aligned with the cavity 120. In the closed position, the cover opening 126 is not aligned with the cavity 120. The cover 110 comprises an inner surface 310, a portion of which defines a profiled engagement member 312. The profiled engagement member 312 comprises a leading edge 314. The profiled engagement member 312 also comprises a trailing edge. However, because the profiled engagement member is curved, the trailing edge cannot be seen in FIG. 3. The trailing edge is shown in FIG. 4.

As shown in FIG. 3*b*, the profiled engagement member 312 slopes towards the cavity when the cover is in the closed position. The slope of the profiled engagement member 312 increases in a direction from the leading edge 314 to a trailing edge (not shown in FIG. 3).

The aerosol-generating device comprises two electrical contacts 302, 303. The aerosol-generating device also comprises a power supply in the form of a rechargeable battery (not shown). The rechargeable battery of the aerosol-generating device is electrically couplable with the two electrical contacts 302 and 303.

FIG. 3 shows the two electrical contacts 304 and 305 located in the cavity of the charger. Electrical contacts 302 and 303 of the aerosol-generating device are aligned with contacts 304 and 305 of the charger when the aerosol-generating device is received in the cavity. When there is electrical connection between the electrical contacts of the charger with the electrical contacts of the aerosol-generating device, the rechargeable battery of the charger can be used to recharge the rechargeable battery of the aerosol-generating device. In order for the rechargeable battery to be reliably charged, the electrical connection must be consistent.

Electrical contacts 304 and 305 are resilient elements in the form of cantilever springs.

The electrical contacts 304 and 305 extend upwards from the closed end of the cavity in the direction of the cavity opening. When the cover 110 is open, and provided the charger remains upright, the aerosol-generating device 300 rests upon the electrical contacts 304 and 305. As described above, the aerosol-generating device 300 has a length which is substantially the same as the length of the cavity (from the closed end of the cavity to the cavity opening). However, because of the upward extension of the electrical contacts 304 and 305, the aerosol-generating device received in the cavity and resting upon the electrical contacts 304 and 305 extends above the level of the cavity opening when the cover is in the open position.

When the cover is in the open position, electrical communication between the electrical contacts 302 and 304 and 303 and 305 is not ensured and so may not be consistent. For example, if the charger 100 is not stored in an upright position, or is shaken or dropped, it is likely that the electrical communication will not be maintained between the electrical contacts of the charger and the electrical contacts of the device.

When the cover 110 is in the closed position (as shown in FIG. 3*b*), electrical communication between the electrical contacts 302 and 304 and 303 and 305 is ensured. This is because, in the closed position, the profiled engagement member 312 of the cover 110 is engagement with a top surface of the aerosol-generating device 322 received in the cavity 120. The engagement ensures that the aerosol-generating device is in electrical communication with electrical contacts 304 and 305 of the charger, irrespective of the orientation of the charger and of any sudden forces applied to the charger, for example, in the case that the charger is dropped. In other words, the engagement ensures that contact is maintained between the electrical contacts 302 and 303 of the charger and the electrical contacts 304 and 305 of the aerosol-generating device.

The profiled engagement member 312 urges the aerosol-generating device into engagement with the contacts of the charger 304 and 305 when the cover is in the closed position. The profiled engagement member 312 applies a force on the top surface 322 of the aerosol-generating device pushing it into the cavity and in the direction of, and against, the electrical contacts 304 and 305. The applied force causes the electrical contacts 304 and 305 to deform, and generate, a reactive force that urges the aerosol-generating device 300 to move away from the electrical contacts (i.e. a reactive force pushing the aerosol-generating device back out of the cavity 120). As the cover is in the closed position, the force applied by the electrical contacts 304 and 305 urges the aerosol-generating device against the cover and, in particular, against the profiled engagement member of the cover. This ensures contact between the aerosol-generating device 300 and the electrical contacts of the charger 304 and 305.

The profiled engagement member 312 is configured to first engage the top surface 322 of the aerosol-generating device 300 received in the cavity 120 at an intermediate position (i.e. a position between the open position and the closed) of the cover. This intermediate position is shown in FIG. 3*c*. As the cover rotatably slides towards the closed position, the profiled engagement member 312 moves into an overlapping relationship with the cavity 120. It is the leading edge 314 that moves into an overlapping relationship with the cavity 120 first. As a result of the slope of the profiled engagement member 312, the profiled engagement member 312 increasingly protrudes towards the cavity as the cover moves from the open position to the closed position. At the intermediate position shown in FIG. 3*c*, the profiled engagement portion protrudes towards the cavity sufficiently to first contact and engage the top surface 322 of the aerosol-generating device 300. Such an arrangement, with the profile engagement member 312 sloped as described, results in a smooth engagement between the profiled engagement portion and the aerosol-generating device.

The profiled engagement member 312 and the aerosol-generating device 300 remain engaged while the cover rotatable slides from the intermediate position show in FIG. 3*c* to the closed position shown in FIG. 3*b*. As the profiled engagement member 312 increasingly protrudes towards the cavity, an increasing force is applied on the aerosol-generating device urging the aerosol-generating device into contact with the electrical contacts 304 and 305. In turn, the electrical contacts 304 and 305 are increasingly deformed from their extended state and so apply an increasing reactive force, urging the aerosol-generating device back out of the cavity.

The profiled engagement member 312 acts as a cam surface and the aerosol-generating device 300 acts as a cam rider, following the slope of the profiled engagement portion. The transverse motion of the profiled engagement member 312, as the cover slides from the open position to the closed position, is transferred to longitudinal motion of the aerosol-generating device, into the cavity.

FIG. 4 shows a perspective view of the cover 110 separated from the charger. This view more clearly shows the profiled engagement member 312 having a leading edge adjacent to the cover opening 126 and a trailing edge 402. The dotted line 404 indicates how the unseen part of the profiled engagement member 312 extends in a curve from the leading edge 314 to the trailing edge 402. The profiled engagement member 312 has the form of a curved rib extending between the leading edge and the trailing edge. The curve matches the rotation of the cover 110 such that cover rotationally sliding the cover causes the profiled engagement member 312 to move into an overlapping relationship with the cavity, and remain in that overlapping relationship as the cover continues to rotationally slide.

Figure 5:
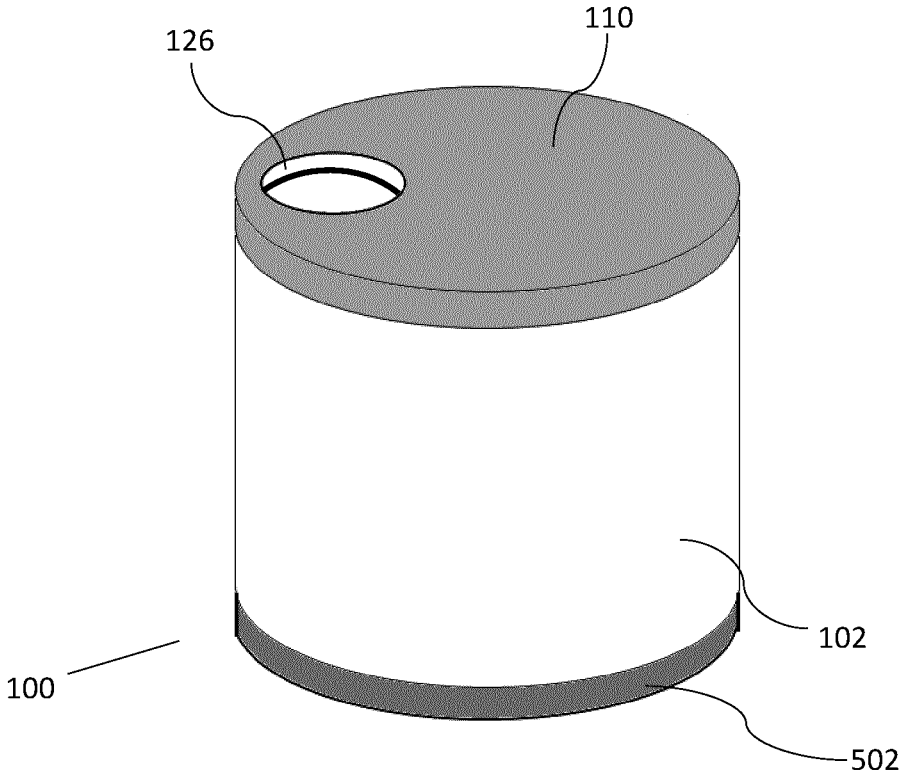
FIG. 5 shows a perspective view of an embodiment of the charger similar to that shown in FIG. 2, further comprising an actuating member in form of a rotatable disk.

In the embodiments so far described, the cover 110 is slidable from an open position to a closed position when a user manipulates the cover directly. FIG. 5 shows a perspective view of an embodiment of the charger where instead of manipulating a cover directly, a user instead manipulates an actuation member. The manipulation of the actuation member results in the cover sliding from the open position to the closed position (or vice versa).

The actuation member is in the form of a rotatable disc 502. The rotatable disc 502 is linked to the cover 110 such that rotating the rotatable disc 502 slides the cover 110 from the open position to the closed position. The rotatable disc 502 can rotate from a first position where the cover is in the open position. This rotation causes the cover to the rotatably slide.

Figure 6:
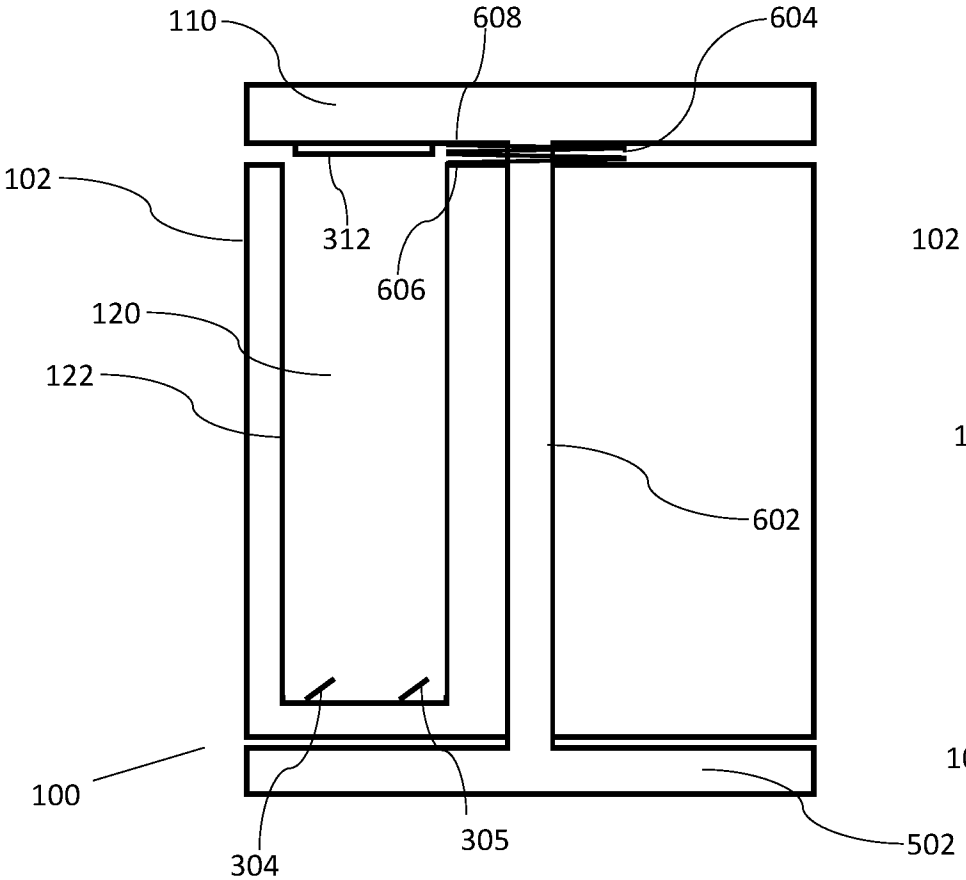
FIG. 6 shows a cross-sectional schematic view of the charger of FIG. 4, showing a mechanical linkage between the rotatable disk and the cover.

FIG. 6 shows a cross-sectional view of the charger of FIG. 4 showing the linkage between the rotatable disk 502 and the cover 110. The linkage between the slider tab 502 and the cover 110 is via rigid shaft 602 and is a direct mechanical linkage. Therefore, rotation of the rotatable disc 502 causes rotation of the cover 110. As the mechanical linkage is directly through the centre of both the rotatable disc 502 and the cover 110, rotation of the rotatable disc 502 causes the cover 110 to rotate in a fixed position relative to the charger housing 102.

The embodiment shown in FIG. 6 also comprises biasing element in the form a spring 604, shown schematically. The spring 604 is attached to charger housing at a first end 606 and to attached to the cover at a second end 608. When the cover is in the open position, the position of the cover 110 relative to the housing 102 causes the spring to be under tension. The spring 604 is deformed when the cover 110 is in the open position. Therefore, the spring applies a force on the cover, urging the cover towards the closed position.

When the cover is in the closed position, the spring is either in its natural, undeformed state, or in a relatively less deformed state. The effect of this is that whenever the cover is in the open position, or an intermediate position between the open position and the closed position, the cover is urged back towards the closed position. This prevents the user of the charger from inadvertently leaving the cover in the open position. If the cover is accidently forced open, the biasing element will automatically close the cover again.

In some embodiments, the actuation member is a button or a switch rather than a rotatable disc. The button or switch is positioned on the charger housing. A user can manipulate the button or switch to operate an actuator positioned in the charger housing. The manipulation can be by pressing the button or switching the switch. Pressing the button or switching the switch sends signals to a controller (not shown). The controller then controls the actuator to moves the cover from the open position to the closed position in response to this manipulation.

Figure 7:
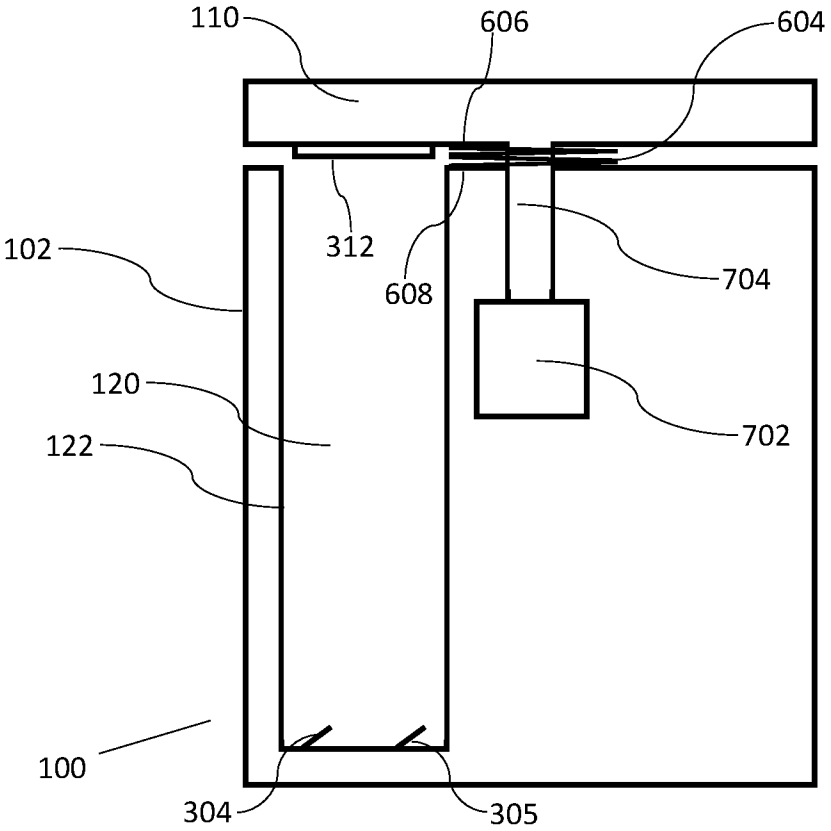
FIG. 7 shows a cross-sectional schematic view of another embodiments of the charger where a motor is used to move the cover from the open position to the closed position.

FIG. 7 shows a cross-sectional view of a charger comprising an actuator in the form of a motor 702. A direct mechanical linkage 704 is a rigid shaft that connects the motor 702 to the cover 110. The motor is configured to receive electrical signals from the button or switch (not shown). When a user presses the button or switches the switch, the controller causes the motor 702 to rotate, as required. This, in turn, moves the cover from the open position to the closed position, or vice versa. The motor 702 is connected to the rechargeable battery of the charger (not shown). The rechargeable battery provides power to the motor 702.

Figure 8:
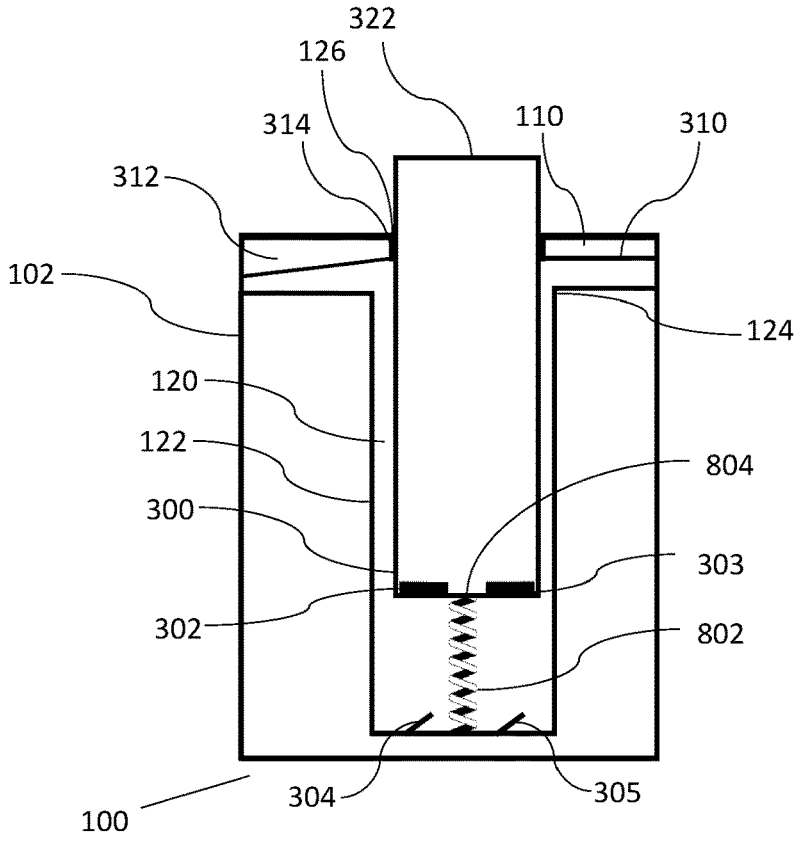
FIG. 8 shows a cross-sectional schematic view of a charger comprising an aerosol-generating device release mechanism, the cover is shown in the open position.

FIG. 8 shows a cross-sectional schematic view of a charger comprising an aerosol-generating device release mechanism, the cover is shown in the open position. The aerosol-generating device release mechanism is a helical spring 802 located in the cavity 120 between electrical contacts 304 and 305. The helical spring is configured to urge the aerosol-generating device 300 out of the cavity 120 (i.e. above cavity opening 124), when the cover is in the open position. The spring 802 pushes on the bottom surface 804 of the aerosol-generating device 300. By urging the aerosol-generating device out of the cavity, the aerosol-generating device may be more easily removed from the charger by a user of the device. This is because a portion of the aerosol-generating device upon which a user can hold on to is provided. Because the aerosol-generating device release mechanism is provided as a spring When the cover is in the closed position, the spring 802 is compressed and the aerosol-generating device is pushed against electrical contacts 304 and 305, as described with respect to previous embodiments. However, in order to close the cover, a user of the device is required to manually push the aerosol-generating device 300 below the level of the cover 110 such that profiled engagement member 312 is able to move into an overlapping relationship with the cavity opening.

Figure 9:
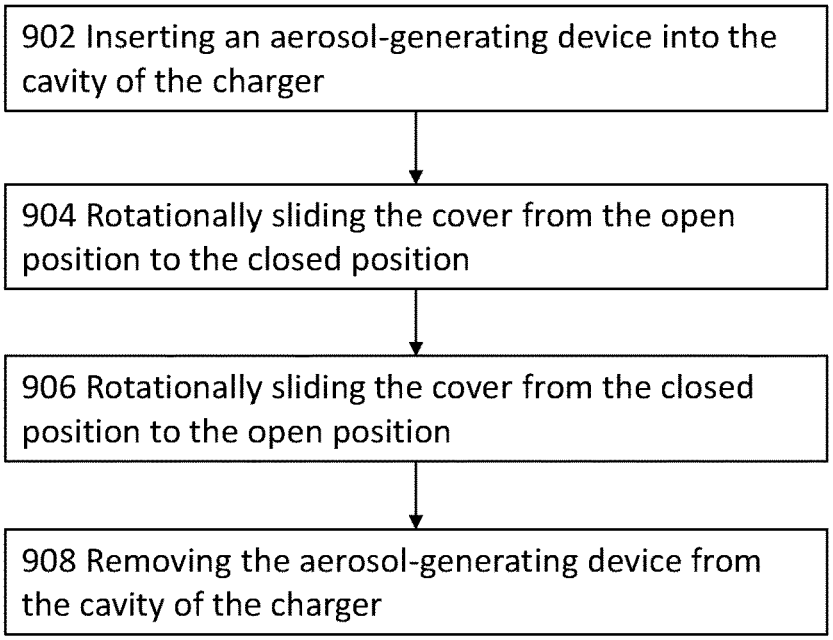
FIG. 9 shows a flow diagram of a method of using an aerosol-generating system comprising the charger and an aerosol-generating device.

FIG. 9 is a flow diagram outlining a method of using aerosol-generating systems according to the disclosure.

At step 902 an aerosol-generating device is received into the cavity of the charger. This is when the cover is in the open position.

At step 904 a user rotationally slides the cover from the open position to the closed position. As described previously, the cover engages the aerosol-generating device as it slides from the open position to the closed position. In the closed position, the cover urges the aerosol-generating device into engagement with at least one electrical contact. This ensures that the electrical connection between the aerosol-generating device and the charger is maintained. The electrical connection allows the aerosol-generating device to be charged by the charger. When the cover is closed, it protects the cavity, and the aerosol-generating device received in the cavity from dust from the surrounding environment.

At step 906 a user rotationally slides the cover from closed position to the open position. A user does this in order to be able to access the aerosol-generating device received in the cavity.

In some embodiments, the cover is biased closed. In these embodiments, the moveable elements automatically return to the closed position from the open position. Therefore, step 904 may be automatic.

In the open position, the aerosol-generating device is urged out of the cavity by an aerosol-generating device release mechanism. By urging the aerosol-generating device out of the cavity, a portion of the aerosol-generating device extends out of the cavity. A user of the aerosol-generating system can use this portion to aid removable of the aerosol-generating device. When the charger comprises an aerosol-generating device release mechanism, step 904 may require the user to manually push the aerosol-generating device into the cavity, compressing the aerosol-generating device release mechanism, before sliding the cover to the closed position.

The invention claimed is:

1. A charger for charging an aerosol-generating device, the charger comprising:

a housing defining a cavity configured to receive the aerosol-generating device to be charged, the cavity having an opening;

at least one electrical contact being disposed in the cavity; and a cover rotationally slidable relative to the opening between an open position and a closed position, an inner surface of the cover facing the cavity when the cover is in the closed position, wherein at least a portion of the inner surface of the cover defines a profiled engagement member having a leading edge and a trailing edge, the profiled engagement member sloping into, or towards, the cavity when the cover is in the closed position, a slope increasing in a direction from the leading edge to the trailing edge of the profiled engagement member.

2. The charger according to claim 1, wherein the profiled engagement member is configured to urge the aerosol-generating device received in the cavity into engagement with the at least one electrical contact when the cover is in the closed position.

3. The charger according to claim 1, wherein the profiled engagement member protrudes into, or towards, the cavity when the cover is in the closed position, a protrusion of the profiled engagement member increasing in the direction from the leading edge to the trailing edge of the profiled engagement member.

4. The charger according to claim 1, further comprising an aerosol-generating device release mechanism configured to urge the aerosol-generating device received in the cavity in a direction of the cavity opening when the cover is in the open position.

5. The charger according to claim 1, wherein the profiled engagement member is a cam surface and a top surface of the aerosol-generating device received in the cavity is a cam rider.

6. The charger according to claim 1, wherein the housing comprises a face over which the cover is rotationally slidable, and wherein, when sliding the cover from the open position to the closed position, the inner surface of the cover does not slide beyond the face of the housing.

7. The charger according to claim 1, further comprising an actuation member and a means to slide the cover from the closed position to the open position in response to manipulation of the actuation member by a user of the charger.

8. The charger according to claim 7, wherein the actuation member is a rotatable disc and the means to slide the cover is a mechanical linkage between the rotatable disc and the cover.

9. The charger according to claim 8, wherein the actuation member is a button or switch and the means to slide the cover comprises an actuator and a mechanical linkage between the actuator and the cover, and wherein the actuation member is configured to send an electrical signal to the actuator in response to manipulation of the actuation member by a user of the charger.

10. The charger according to claim 1, wherein the cover comprises a cover opening alignable with the cavity when the cover is in the open position.

11. The charger according to claim 1, wherein the profiled engagement member is a curved rib.

12. The charger according to claim 11, wherein the housing is cylindrical.

13. The charger according to claim 1, wherein the cover is biased towards the closed position.

14. An aerosol generating system, comprising:

a charger; and an aerosol-generating device, the charger comprising:

a housing defining a cavity configured to receive the aerosol-generating device to be charged, the cavity having an opening, at least one electrical contact being disposed in the cavity, and a cover rotationally slidable relative to the opening between an open position and a closed position, an inner surface of the cover facing the cavity when the cover is in the closed position, wherein at least a portion of the inner surface of the cover defines a profiled engagement member having a leading edge and a trailing edge, the profiled engagement member sloping into, or towards, the cavity when the cover is in the closed position, a slope increasing in a direction from the leading edge to the trailing edge of the profiled engagement member.

15. A method of operating an aerosol-generating system comprising a charger and an aerosol-generating device, the charger comprising:

a housing defining a cavity configured to receive the aerosol-generating device to be charged, the cavity having an opening, at least one electrical contact being disposed in the cavity, and a cover rotationally slidable relative to the opening between an open position and a closed position, an inner surface of the cover facing the cavity when the cover is in the closed position, wherein at least a portion of the inner surface of the cover defines a profiled engagement member having a leading edge and a trailing edge, the profiled engagement member sloping into, or towards, the cavity when the cover is in the closed position, a slope increasing in a direction from the leading edge to the trailing edge of the profiled engagement member; and the method comprising:

inserting the aerosol-generating device into the cavity of the charger when the cover is in the open position; and sliding the cover from the open position to the closed position, wherein, in the closed position, the profiled engagement member urges the aerosol-generating device into engagement with the at least one electrical contact.

* * * * *